United States Patent [19]

Ross

[11] Patent Number: 4,768,252

[45] Date of Patent: Sep. 6, 1988

[54] FITTED SHEET

[76] Inventor: Anthony J. Ross, 526-74th St., Anna Marie Island, Holmes Beach, Fla. 33510

[21] Appl. No.: 28,797

[22] Filed: Mar. 23, 1987

[51] Int. Cl.[4] ..... A47G 9/04

[52] U.S. Cl. ..... 5/497; 5/498

[58] Field of Search ..... 5/495, 499, 497, 498, 5/494; 297/219

[56] References Cited

U.S. PATENT DOCUMENTS

| | | | |
|---|---|---|---|
| 1,897,521 | 2/1933 | Lagarde | 5/499 |
| 2,214,074 | 9/1940 | Clarke | 5/499 |
| 2,695,414 | 11/1954 | Ford et al. | 5/485 |
| 2,696,872 | 12/1954 | Kurland et al. . | |
| 2,791,784 | 5/1957 | Tomsic . | |
| 2,801,427 | 8/1957 | Crocker . | |
| 2,857,643 | 10/1958 | Tomsic . | |
| 2,994,094 | 8/1961 | Hester | 5/497 |
| 3,114,156 | 12/1963 | Cobb . | |
| 3,256,038 | 6/1966 | Edelson et al. | 5/497 |
| 3,636,575 | 1/1972 | Smith | 5/499 |
| 3,906,559 | 9/1975 | Bahr . | |
| 4,316,299 | 2/1982 | Friedman | 5/497 |
| 4,461,049 | 7/1984 | Hammond . | |
| 4,606,290 | 8/1986 | Marzotto | 5/498 |
| 4,644,598 | 2/1987 | McGuire et al. | 5/497 |
| 4,662,013 | 5/1987 | Harrison | 5/497 |

FOREIGN PATENT DOCUMENTS

| | | | |
|---|---|---|---|
| 2853226 | 6/1979 | Fed. Rep. of Germany | 5/497 |
| 1201731 | 8/1970 | United Kingdom | 5/498 |

*Primary Examiner*—Alexander Grosz
*Assistant Examiner*—Eric K. Nicholson
*Attorney, Agent, or Firm*—Vernon J. Pillote

[57] ABSTRACT

A fitted sheet comprising top, side and end panels for covering the top, sides and ends of a mattress with adjacent ends of the side and end panels connected together to form vertical corners and with the lower portions of the side and end panels extending into underlying relation with the underside of the mattress. Elastic corner bands are attached to each side panel at a location adjacent one end panel and are otherwise attached to the same end panel. A cross band is attached to the lower edges of the side panels at a location adjacent the point of attachment of the corner bands thereto.

5 Claims, 1 Drawing Sheet

FITTED SHEET

BACKGROUND OF THE INVENTION

Fitted sheets for covering a mattress, are well known. Some fitted sheets such as disclosed in U.S. Pat. Nos. 2,791,784; 2,857,643 and 4,461,049, provide straps that extend diagonally between the corners of the fitted sheet at the underside of the mattress to aid in maintaining the fitted sheet on the mattress. Some others such as disclosed in U.S. Pat. Nos. 2,696,872 and 3,906,559, provide straps that extend crosswise between the side panels of the fitted sheet at the underside of the mattress. U.S. Pat. No. 3,114,156 discloses a fitted sheet having elastic gussets at the corners. U.S. Pat. No. 2,801,427 discloses a bed pad having some straps located adjacent the corners and which can be tied together to extend diagonally between the corners of the bed pad, and additional straps that can be tied together to extend crosswise of the fitted sheet at locations remote from the diagonally extending straps.

SUMMARY OF THE INVENTION

It is an object of the present invention to provide a fitted sheet having an improved arrangement for maintaining the fitted sheet on the mattress.

It is another object of this invention to provide a fitted sheet in accordance with the foregoing object and which enables the fitted sheet to be easily installed on and removed from the mattress.

Accordingly, the present invention provides a fitted sheet having top, side and end panels for covering the top, side and ends of a mattress with the lower edges of the side and end panels spaced from the top panel a distance greater than the height of the mattress so that lower portions of the side and end panels extend below the bottom surface of the mattress. First and second elastic corner bands are attached to the side and end panels at locations spaced a preselected distance from the lower edge of the side and end panels to extend diagonally therebetween, and an elastic cross band is attached to the side panels at locations adjacent the location of attachment of the first and second corner band to the side panels, to extend between the side panel generally parallel to the lower edge of the end panel.

The reference S has been applied generally to a fitted sheet for use on a rectangular mattress M. The sheet S is formed of a flexible fabric material and includes a top panel 10, first and second side panels 11 and 12, and first and second end panels 13 and 14. The top panel is dimensioned to cover the top of the mattress and the side and end panels are connected together as by stitching to form vertical corners 20 at the corners of the mattress. The side and end panels cover the sides and ends of the mattress M and the side panels 11 and 12 have lower side edges 11*a* and 12*a* respectively and the end panels 13 and 14 have lower side edges 13*a* and 14*a* respectively that are spaced from the top panel a distance greater than the height of the mattress on which the sheet is applied so that lower portions 11*b*–14*b* on the side and end panels 11–14 respectively extend below the bottom surface of the mattress and form side and end flaps that underlie the bottom of the mattress.

Figure 1:
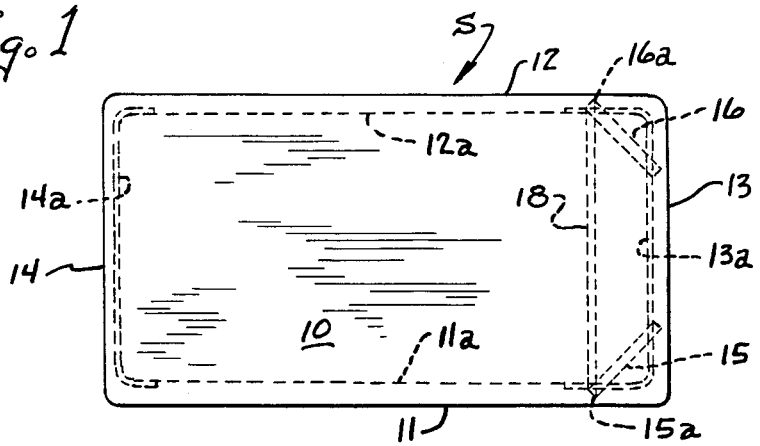
FIG. 1 is a top view of a fitted sheet shown applied to a mattress.
Figure 2:
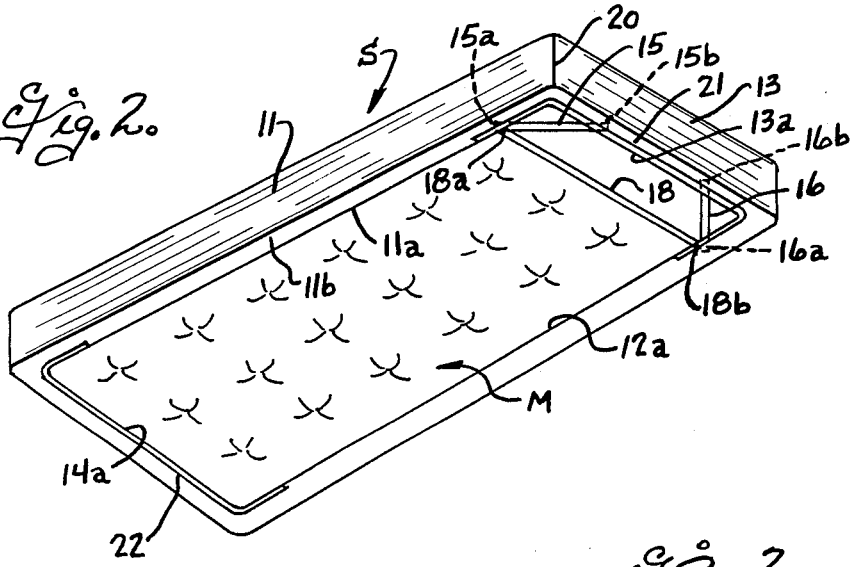
FIG. 2 is a perspective view from the bottom of the mattress showing the fitted sheet applied thereto.
Figure 3:
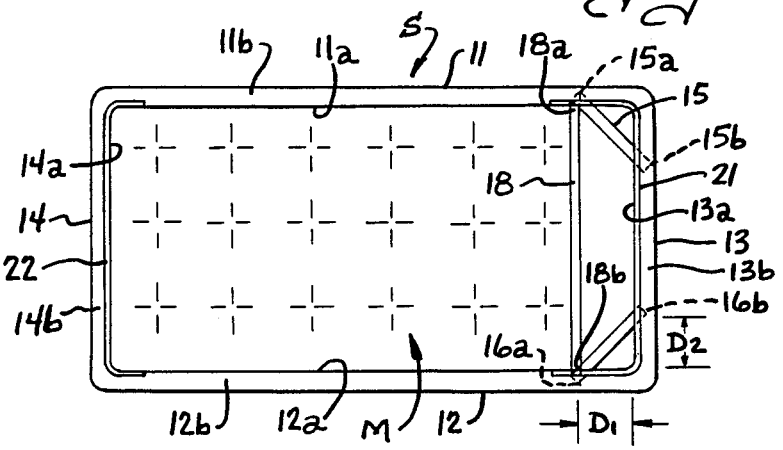
FIG. 3 is a bottom view of the mattress with a fitted sheet applied thereto.

First and second elastic corner bands 15 and 16 each have first end portions 15*a*, 16*a* respectively attached to the side panels 11, 12 at a location spaced a distance designated D1 in FIG. 3 from the lower edge 13*a* of one end panel 13, and second end portions 15*b*, 16*b* attached to the same end panel 13 adjacent the lower-edge thereof at a location spaced a distance designated D2 in FIG. 3 from the lower edge of the respective one of the side panels 11, 12. An elastic cross band 18 has end portions 18*a* and 18*b* attached to the side panels 11 and 12 adjacent their lower edge and at locations adjacent location of attachment of the respective first and second corner bands, and such that the cross bands extend between the lower edge of the side panels generally parallel to the lower edge of the end panel 13.

The fitted sheet S may be formed of woven textile material as well as non-woven webs. As used herein, the term sheet is intended to cover not only single ply sheets but also multiple ply and padded sheets such as are used in bed pads. Mattresses generally have a height about seven or eight inches and the side and end panels of the fitted sheet have a height somewhat greater than the height of the mattress so as to provide lower portions or flaps 11*b*–14*b* that extend a distance such as one or two inches into underlying relation to the bottom surface of the mattress around the perimeter of the mattress. The distance D1 between the edge 13*a* of one end panel and the location of attachment of the corner bands 15, 16 to the respective side panels 11 and 12 is preferably made in the range of about six to eight inches and the cross band 18 is attached to the side panels adjacent the location of attachment of the corner bands thereto. The distance D1 is thus in a range that approximates within one or two inches the height of the mattress to which the fitted sheet is applied and the cross band 18 extends generally parallel to the edge 13*a* of the end panel 13 and is spaced therefrom a distance that approximates within one or two inches the height of the mattress. The corner bands 15, 16 and cross band 18 are preferably attached to the side and end panels by stitching, it being understood that they can also be applied by other means such as fabric adhesives, snaps or clips such as shown in U.S. Pat. No. 2,857,643. The distance D2 between the lower edge of the side panels 11 and 12 and the point of attachment of the corner bands 15, 16 to the end panel 13 is preferably in a range approximating the range of the distance D1, that is in a range similar to the height of the mattress. The elastic corner bands 15, 16 are arranged so that they are in a partially stretched condition when the fitted sheet is applied to the mattress, so as to draw the lower portions of the sheet into underlying relation with the bottom of the mattress, to aid in maintaining the sheet in a taut condition. The elastic band 18 is selected to have a length sufficiently less than the spacing between the edges 11*a*, 12*a* of the side panel of the sheet to exert tension therebetween and draw the lower portions of the side panels into underlying relation to the bottom of the mattress. To simplify manufacture, the cross band 18 and corner bands 15, 16 are advantageously formed in a single piece with the corner bands folded at an angle relative to the cross band and secured to the respective side panel. Hem members 21 and 22, preferably of elastic material, are advantageously provided along the lower edges of the end panels 13, 14 and at least along portions of the side panels to aid in drawing the lower portions of the side and end panels into underlying relation with the mattress. The band 21 preferably extends from the end panel 13 and along the side panels at least to the location of attachment of the corner bands and cross band thereto.

While the fitted sheet is herein shown with a pair of corner bands and a cross band at one end of the fitted sheet, it is to be understood that a similar arrangement can be provided at the opposite end of the sheet.

From the foregoing it is thought that the construction and use of the fitted sheet will be readily understood. The corner bands 15, 16 and cross band 18 are attached to the side panels at a location spaced from one end panel a distance approximating the height of the mattress so that the fitted sheet with the corner bands and cross band affixed can be easily slipped over the end of the mattress during installation and removal of the fitted sheet. It has been found that the provision of the corner bands and cross bands that extend between the side panels at the location of attachment of the corner bands thereto, markedly improves retention of the fitted sheet on the mattress. In this regard it will be seen that any forces on the fitted sheet that tend to move the lower portion of either side panel of the fitted sheet out of underlying relation to the mattress, will be transmitted by the attached corner band to the adjacent end panel and is also transmitted by the cross band 18 to the opposite side panel.

The embodiments of the invention in which an exclusive property or privilege is claimed are defined as follows:

1. A fitted sheet for a rectangular mattress comprising:

(a) top, side and end panels for covering the top, sides and ends respectively of a mattress with adjacent ends of the side and end panels seamed together to form vertical corners, the side and end panels each having lower edges extending lengthwise thereof and spaced from the top panel, (b) an elongated elastic first corner band having a first end portion attached to one side panel adjacent the lower edge thereof at a location spaced a first preselected distance from the lower edge of one end panel, the first corner band having a second end portion attached to said one end panel adjacent the lower edge thereof at a location spaced a second preselected distnace from the lower edge of said one side panel, (c) an elongated second corner band having a first end portion attached to the other side panel adjacent the lower edge thereof at a location spaced approximately the same as said first preselected distance from the lower edge of said one end panel, the second corner band having a second end portion attached to said other one side panel at a location spaced approximately the same as said second preselected distance from the lower edge of said other side panel, (d) an elongated cross band having one end portion attached to said one side panel at the location of attachement of the first end portion of the first corner band to said one side panel, the cross band having a second end portion attached to said other side panel at the location of attachment of the first end portion of the second corner band to said other side panel, (e) the first and second corner bands each extending diagonally with respect to the lower edge of a respective one of the side panels and said one end panel and spaced from the corner therebetween, said cross band extending between the lower edges of the side panels generally parallel to and spaced from the lower edge of said one end panel.

2. A fitted sheet according to claim 1 wherein said first preselected distance is in a range of about six to eight inches.

3. A fitted sheet according to claim 1 wherein first and second preselected distances are each in a range of about 6 to 8 inches.

4. A fitted sheet according to claim 1 including an elastic member attached in a stretched condition to the lower edge of said one end panel and to the lower edge of said side panels between said one end panel and the location of attachment of the cross band thereto.

5. A fitted sheet according to claim 1 wherein the cross band and first and second corner bands are formed of a single piece with the corner bands folded to extend at an angle to the cross band.

* * * * *